US006042222A

United States Patent [19]

Moritz, III et al.

[11] Patent Number: 6,042,222

[45] Date of Patent: Mar. 28, 2000

[54] PINCH POINT ANGLE VARIATION AMONG MULTIPLE NOZZLE FEED CHANNELS

[75] Inventors: Jules G. Moritz, III, Corvallis; Patrick J. Coven, Albany, both of Oreg.; Dustin W. Blair, San Diego, Calif.

[73] Assignee: Hewlett-Packard Company, Palo Alto, Calif.

[21] Appl. No.: 08/921,217

[22] Filed: Aug. 27, 1997

[51] Int. Cl.[7] ..... B41J 2/05

[52] U.S. Cl. ..... 347/65; 347/94

[58] Field of Search ..... 347/65, 63, 94

[56] References Cited

U.S. PATENT DOCUMENTS

| | | | |
|---|---|---|---|
| 4,882,595 | 11/1989 | Trueba et al. | 347/65 |
| 5,291,226 | 3/1994 | Schantz et al. | 347/63 |
| 5,308,442 | 5/1994 | Taub et al. | 347/65 X |
| 5,387,314 | 2/1995 | Baughman et al. | 347/65 X |
| 5,519,423 | 5/1996 | Moritz et al. | 347/65 |
| 5,563,642 | 10/1996 | Keefe | 347/84 |
| 5,608,436 | 3/1997 | Baughman | 347/65 |

*Primary Examiner*—Joseph Hartary

[57] ABSTRACT

An inkjet printhead includes multiple printing elements grouped in sets about an ink refill channel. Each printing element includes a nozzle chamber and firing resistor. Respective nozzle chambers are located at a staggered distance away from the ink refill channel. A printing element's feed channel couples its nozzle chamber to the ink refill channel. A pinch point defined by barrier walls occurs along the feed channel. Converging and diverging half angles for each barrier wall of a given printing element are the same. Such angles differ among a plurality of printing elements. The specific angle for a given printing element defines where along the feed channel the pinch point occurs. The specific angle is prescribed according to the distance from a given printing element's firing resistor to the ink refill channel. A certain angle is used for a certain resistor stagger position to provide ink refill balancing among printing elements.

12 Claims, 4 Drawing Sheets

PINCH POINT ANGLE VARIATION AMONG MULTIPLE NOZZLE FEED CHANNELS

BACKGROUND OF THE INVENTION

This invention relates generally to inkjet printhead structures, and more particularly, to active inkjet printhead structures for introducing ink into firing chambers from which ink is ejected onto print media.

An inkjet printhead includes multiple firing chambers for ejecting ink onto a print media to form characters, symbols and/or graphics. Typically, the ink is stored in a reservoir and passively loaded into respective firing chambers via an ink refill channel and respective ink feed channels. Capillary action moves the ink from the reservoir through the refill channel and ink feed channels into the respective firing chambers. Firing chambers typically occur as cavities in a barrier layer. Associated with each firing chamber is a firing resistor and a nozzle. The firing resistors are formed on a common substrate. The barrier layer is attached to the substrate. By activating a firing resistor, an expanding vapor bubble forms which forces ink from the firing chamber into the corresponding nozzle and out a nozzle orifice. A nozzle plate adjacent to the barrier layer defines the nozzle orifices. The geometry of the firing chamber, ink feed channel and nozzle defines how quickly a corresponding firing chamber is refilled after nozzle firing.

Typical passive loading of a nozzle chamber includes the rapid flow of ink into the chamber after firing. The ink flow action is characterized as a repeating flow and ebb process in which ink flows into the chamber, then back-flows slightly. Channel geometry defines passive damping qualities which limit the ink in-flow, while back-pressure and orifice diameter determine a steady-state chamber height. The flow and ebb cycle is passively damped until a steady state chamber level is maintained. The time to first achieve a steady state level is referred to as "refill time". The refill time limits the maximum repetition rate at which printhead nozzles can operate.

It is desired to achieve ejection of ink drops having known repeatable volume and shape. Firing a nozzle after a previous firing may result in either an "overshoot" or an "undershoot" condition. Overshoot is when the volume of ink in the firing chamber is above a steady state volume. Firing at such time causes a relatively larger droplet to be ejected. Undershoot is when the volume of ink in the firing chamber is below the steady state volume. Firing at such time causes a relatively smaller droplet to be ejected.

Current thermal inkjet printheads use a resistor multiplex pattern which allows the resistors to be fired at different times. Typically, the resistors are offset spatially to compensate for such timing. Typically, a vertical edge, or shelf, is formed along the ink refill channel. The ink feed channels are in fluid communication with the ink refill channel via the shelf. The respective resistors are staggered relative to the shelf, thereby creating different path lengths from the refill channel to the respective firing chambers. The differing path lengths result in different resistance to ink flow, and thus, vary the time it takes to refill each firing chamber. The different path lengths also vary the damping action at the firing chamber.

One challenge when implementing a multiplex pattern of adjacent resistors and firing chambers is to avoid cross-talk between neighboring firing chambers. Cross-talk, as used herein, refers to the condition during which fluid dynamics for one feed channel/firing chamber affects the fluid dynamics for another feed channel/firing chamber.

SUMMARY OF THE INVENTION

According to the invention, a single pinch point is formed along a feed channel of an inkjet printing element. An inkjet printhead includes multiple printing elements. Each printing element includes a nozzle chamber and a firing resistor. Among multiple printing elements the nozzle chamber is located at a staggered distance away from an ink refill channel. The printing element's feed channel couples its nozzle chamber to the ink refill channel. A pinch point occurs along the feed channel. A barrier defines the feed channel. Converging and diverging half angles for each feed channel of a given printing element are the same. Such angles differ among a plurality of printing elements. As the feed channel has a common width at the nozzle chamber, the specific angle for a given printing element defines where along the feed channel the pinch point occurs. The entrance width relative to the ink refill channel also is determined by the specific angle for the given printing element.

According to another aspect of the invention, the specific angle is prescribed according to the distance from a given printing element's firing resistor to the ink refill channel. A certain angle is used for a certain resistor stagger position to provide ink refill balancing among the plurality of inkjet printing elements.

According to a preferred embodiment, an inkjet printhead for ejecting ink droplets onto a print medium includes a plurality of printing elements formed in one or more layers and an ink refill channel defined by an edge. The plurality of printing elements are grouped into sets, with component resistive elements of a given set staggered at different distances from the edge. Each one of a multiple of said plurality of printing elements includes a resistive element, nozzle, firing chamber and feed channel. The resistive element heats ink supplied from a reservoir to generate the ink droplets. The ink droplets are ejected through the nozzle. The firing chamber is enclosed on its sides by a first layer, the barrier layer, and has a base supporting the resistive element. The nozzle is aligned with the firing chamber. The ink feed channel supplies ink to the firing chamber through an entrance on a side of the firing chamber. The feed channel is defined by barrier walls of the first layer. The barrier walls define a pinch point along the feed channel. Specifically, the barrier walls define converging and diverging half angles. The barrier wall portions defining the converging half angles serve to slow down ink refill speed. The barrier wall portions defining the diverging half angles serve as a diffusion barrier resisting back flow during nozzle firing.

For any given printing element the barrier wall converging angles are equal to the barrier wall diverging angles. The feed channel opens from a first width at the pinch point to a wider width at the nozzle chamber entrance. The barrier walls are generally straight along the converging half angle portion and along the diverging half angle portion. (The barrier wall is rounded however at the pinch point.) The nozzle chamber entrance is the same width for each printing element. Given a feed channel width, the location of the pinch point along the length of the feed channel is determined by the specific diverging angle of the barrier wall of a given printing element. The specific diverging angle is prescribed according to the length from the ink refill channel to the firing resistor. Thus, for printing elements having firing resistors located at staggered positions, the pinch point angles vary. In turn the location of the pinch point varies among such printing elements.

In some embodiments the edge further defines a shelf adjacent to the refill channel. The shelf provides communication between the ink refill channel and the ink feed channels. Because the converging angle is prescribed according to the distance from the firing resistor to the refill channel, and because the barrier wall defining the converging half angles of the pinch point are generally straight, the barrier wall may intersect the barrier wall of an adjacent printing element before reaching the refill channel. Thus, the shelf length from the refill channel to the opening into the feed channel may vary depending on the spacing between printing elements.

According to an advantage of this invention, the variable pinch point angle among a set of printing elements substantially reduces volume and velocity variation from printing element to printing element over time for multiple firings at a given firing frequency. According to another advantage of the invention, the variable pinch point angle among a set of printing elements substantially reduces volume and velocity variation from printing element to printing element under steady state conditions. According to another advantage of the invention, ink refill is balanced from printing element to printing element even with high density printing element spacing and short shelf lengths. These and other aspects and advantages of the invention will be better understood by reference to the following detailed description taken in conjunction with the accompanying drawings.

DESCRIPTION OF SPECIFIC EMBODIMENTS

Figure 1:
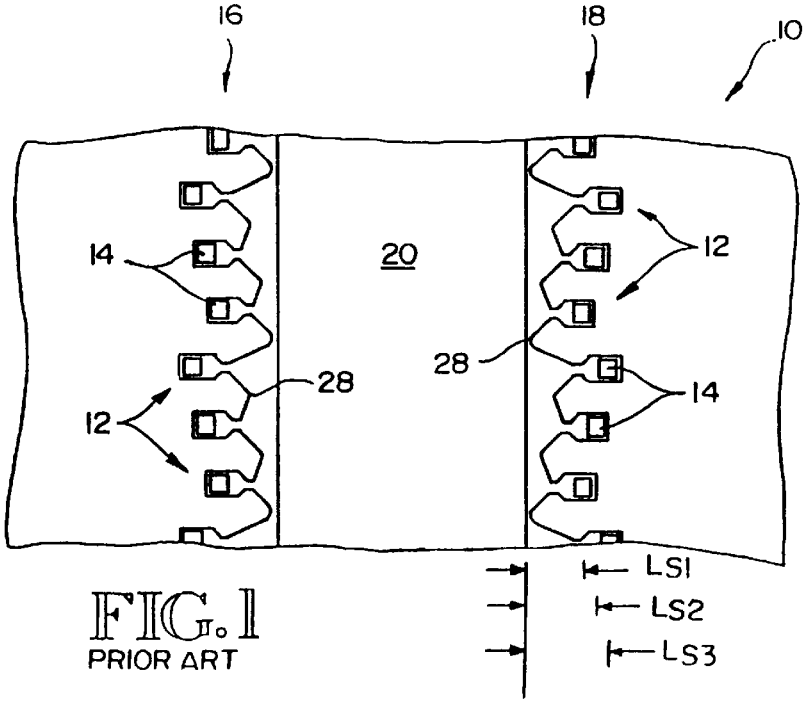
FIG. 1 PRIOR ART
FIG. 1 is a plan view of a portion of a conventional inkjet printhead in which the printhead nozzle plate is not shown.

FIG. 1 shows a portion of a conventional inkjet printhead 10, including a plurality of printing elements 12. Each printing element 12 includes a firing resistor 14. For a center refill channel embodiment as shown, the printing elements are generally arranged in two parallel rows 16, 18 on either side of an ink refill channel 20. In another conventional printhead (not shown), referred to as an edge-feed architecture, the refill channel is at each of two edges of the substrate. Ink flows from a reservoir (not shown) into the ink refill channel 20, then into respective printing elements 12. Firing chambers 26 (see FIG. 2) including the corresponding firing resistors 14 are at a staggered distance from the refill channel 20. Path lengths $L_{s1}$, $L_{s2}$, $L_{s3}$ from the refill channel 20 to the centers of the firing resistor 14 are shown for three printing elements 12. A conventional printhead includes up to 22 different path lengths, $L_s$.

Figure 2:
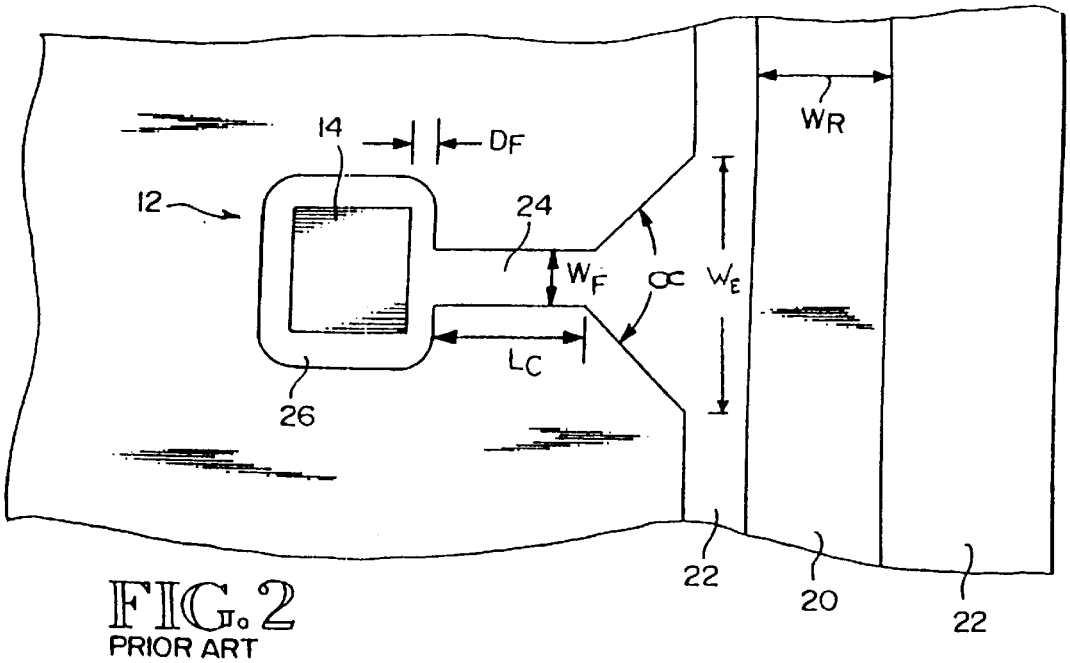
FIG. 2 PRIOR ART
FIG. 2 is a plan view of a conventional printing element and ink refill channel for the printhead of FIG. 1.

FIG. 2 shows a plan view of a conventional printing element 12 in more detail. The ink refill channel 20 has a width $W_R$. A shelf 22 is formed at each edge of the refill channel 20. Respective ink feed channels 24 formed on the shelf 22 provide ink communication between respective firing chambers 26 and the ink refill channel 20. A given feed channel 24 has a length $L_c$ and a width $W_F$. An interval distance $D_F$ occurs within the firing chamber 26 from a far end of the feed channel 24 to a proximal edge of the firing resistor 14. The feed channel has an entrance width, $W_E$.

Printing Element

Figure 3:
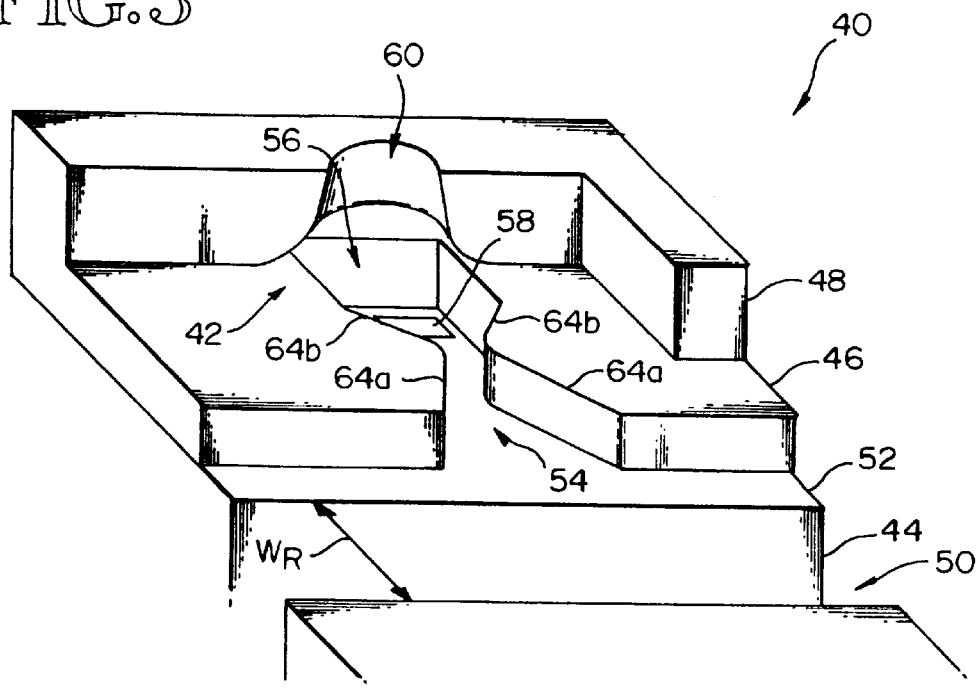
FIG. 3 is a cutaway view of a portion of an inkjet printhead according to an embodiment of this invention.

FIG. 3 shows a printer element 42 portion of a printhead 40 according to an embodiment of this invention. The printhead 40 includes a substrate 44, a barrier layer 46, and a nozzle plate 48. The printer element 42 is formed in the three layers 44, 46, 48. The barrier layer 46 is deposited onto the substrate 44 and is offset from an refill channel 50. In one embodiment the ink refill channel 50 is etched through a portion of the substrate 44 (e.g., for a center feed construction). In another embodiment ink refill channels 50 are formed adjacent to two sides of the substrate 44 (e.g., for edge feed construction). The portion of the substrate 44 adjacent to the refill channel(s) 50 and barrier layer 46 define a shelf 52. For center feed construction the shelf 52 is formed on each side of the refill channel 50.

Etched within the barrier layer 46 is an ink feed channel 54 and a firing chamber 56. A firing resistor 58 is situated within the firing chamber 56 and formed on the substrate 44. The nozzle plate 48 includes an opening, or nozzle 60, aligned with the firing chamber 56. The nozzle plate 48 also forms a border covering the feed channel 54, shelf 52 and refill channel 50. In practice the nozzle plate 48 includes a plurality of orifices, each one operatively associated with a firing chamber 56 to define an inkjet nozzle 60 from which an ink droplet is ejected. In some embodiments the orifices are formed by a laser-ablation method. Different methods of forming the orifices result in different geometries. In alternative embodiments, the barrier layer 46 and nozzle plate 48 are formed by a common layer.

In operation ink fills the refill channel 50, feed channel 54 and firing chamber 56. The ink forms a meniscus bulging into the nozzle 60. The firing resistor 58 is connected by an electrically conductive trace (not shown) to a current source. The current source is under the control of a processing unit (not shown), and sends current pulses to select firing resistors 58. An activated firing resistor 58 causes an expanding vapor bubble to form in the firing chamber 56 forcing such ink out through the nozzle 60. The result is a droplet of ink ejected onto a media sheet at a specific location. Such droplet, as appearing on the media sheet, is referred to as a dot. Conventionally, characters, symbols and graphics are formed on a media sheet at a resolution of 90, 180, 300 or 600 dots per inch. Higher resolutions also are possible.

Figure 4:
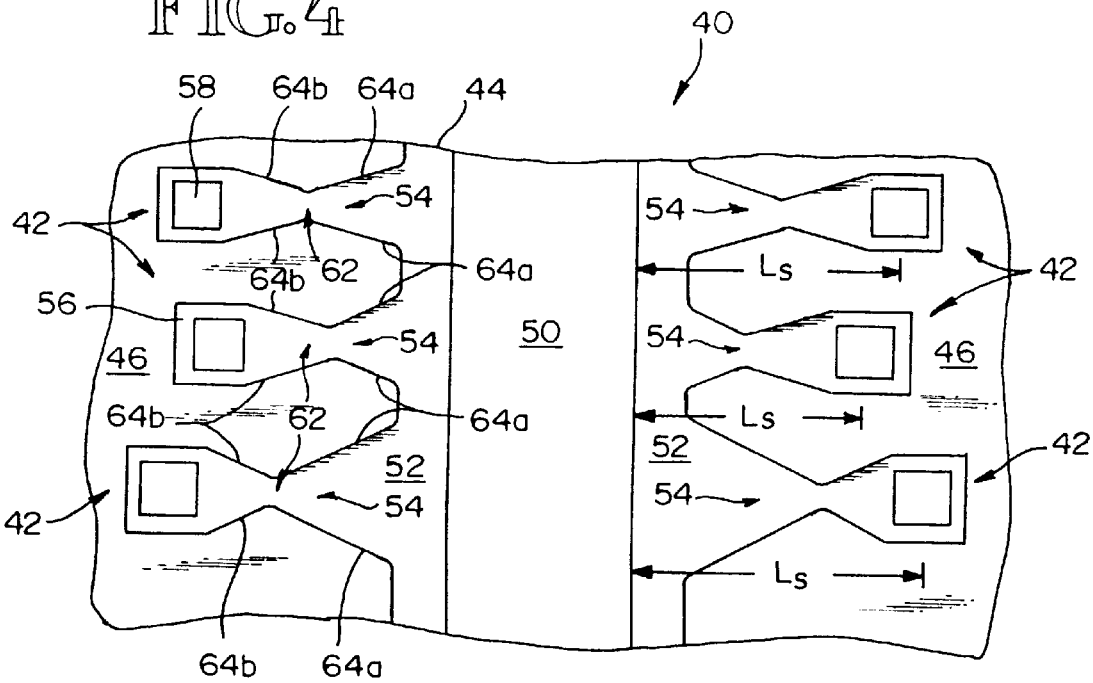
FIG. 4 is a plan view of a portion of an inkjet printhead according to an embodiment of this invention (in which the printhead nozzle plate is not shown)

FIG. 4 shows a partial multiplex pattern of printing elements 42 according to a center feed construction, absent the nozzle plate 48. In an alternative embodiment (not shown), edge feed construction is implemented. The centers of the firing resistors 58 are defined at a staggered distance, $L_s$, from the refill channel 50. In a preferred embodiment, a stagger pattern of approximately 20 different lengths $L_s$ is formed and repeated over sets of approximately 20 corresponding printing elements 42. In various embodiments a pattern repeats for sets of printing elements 42 (e.g., 2, 3 or 4 elements per set for varying embodiments).

For all printing elements 42 a pinch point constriction 62 is formed along the feed channel 54. Such constriction 62 serves as a diffusion barrier resisting back flow of ink (or bubble blow back) into the feed channel 54 during nozzle firing. The constriction 62 also serves to slow down refill speed feed channels 54. The pinch point constriction is defined by angled barrier walls 64. From the shelf 52 barrier wall portions 64*a* converge to form the pinch point constriction. Barrier wall portions 64*b* then diverge from the pinch point constriction 62 to the nozzle chamber 56.

Figure 5:
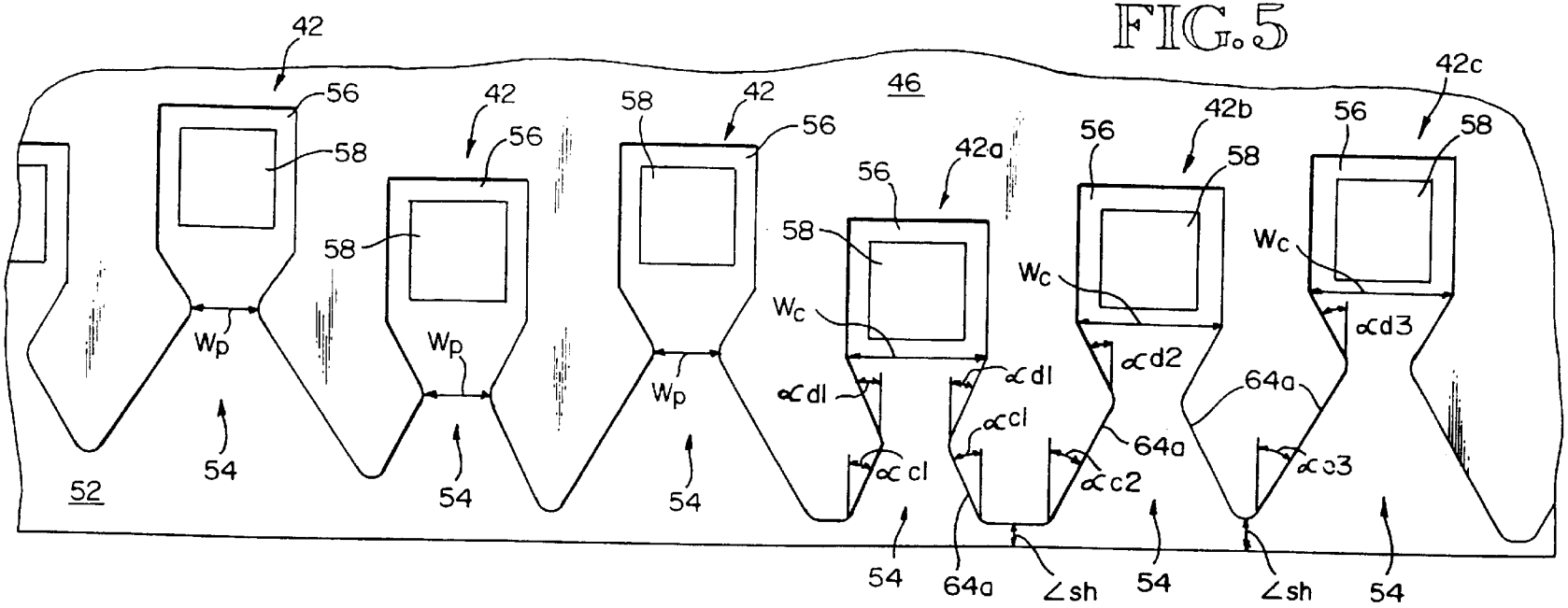
FIG. 5 is a plan view of another portion of an inkjet printhead according to an embodiment of this invention (in which the printhead nozzle plate is not shown)

Referring to FIG. 5, the feed channel 54 width, $W_p$, at the pinch point constriction is the same for all printing elements 42. The feed channel 54 opens to the nozzle chamber width, $W_c$. According to an aspect of this invention for a given printing element 42, the barrier walls 64*a* form converging half angles $\alpha_c$ and diverging half angles $\alpha_d$. Each converging half angle and diverging half angle for a given printing element 42 are the same angle. Thus, $\alpha_c=\alpha_d$. Such equal angle, however, differs for other printing elements in the multiplex pattern of printing elements. FIG. 5 shows printing elements 42*a*, 42*b* and 42*c* of staggered length. The equal angles $\alpha_{c1}$, $\alpha_{d1}$ of element 42*a* differ from the equal angles ac2, ccd2 of element 42*b* and the equal angles $\alpha_{c3}$, $\alpha_{d3}$ of element 42*c*.

Among all printing elements in a multiplex pattern of printing elements, the pinch point channel width, $W_p$, is the same. Also, the nozzle chamber width, $W_c$, is the same, although wider than the width $W_p$. Also, the barrier wall portions 64*b* are generally straight. With straight barrier wall portions 64*b* defining diverging angles $\alpha_d$ widening the feed channel 54 to the nozzle chamber width $W_c$, the pinch point constriction 62 is prescribed to a derived location. For a printer element 42*b* having a larger diverging angle $\alpha_{d2}$ greater than a diverging $\alpha_{d1}$ of printer element 42*a*, the length from the center of the firing resistor 58 to the pinch point constriction 62 for printing element 42*b* is shorter than for printing element 42*a*. In one embodiment the angles $\alpha_c=\alpha_d$ range from 19.56° to 33.44° among a multiplexed pattern of staggered printing elements.

With the pinch point constriction 62 derived to a prescribed location for each given printing element based upon the angle $\alpha_c=\alpha_d$, the entry portion also is derived. The feed channel 54 from the constriction 62 toward the refill channel 50 opens at the half angles $\alpha_c$. The spacing between printing elements 42 and the length, $L_s$, of the printing element determines the location of the feed channel opening. Note in FIG. 5, the barrier wall portions 64*a* of elements 42*b* and 42*c* angle toward each other and intersect farther from the refill channel 50 than the wall portions 64*a* of elements 42*a* and 42*b*. Thus, the shelf length, $L_{sh}$, differs between elements 42*b* and 42*c* compared to the shelf length, $L_{sh}$, between elements 42*a* and 42*b*.

Following is an equation for pressure drop in a feed channel which can be used to determine a desired angle $\alpha_c=\alpha_d$ for a given printing element 42:

$$\Delta P = \frac{128\mu Q}{\Pi}\int_0^L \frac{1}{D_{eq}(z)}dz$$

where P=the pressure drop through a given feed channel
Q=volumetric flow rate;
$\mu$=viscosity;
Deq=equivalent hydraulic diameter of feed channel 54; and
$L=L_s$=length between refill channel 50 and firing chamber 56.

The pressure drop is constant for each feed channel, being at the refill channel pressure at the entrance and at the nozzle pressure at the exit. The goal is to match the volumetric flow rate, Q, for each feed channel regardless of the feed channel length, $L_s$. To do so, the equivalent hydraulic diameter, $D_{eq}$, is increased as the length, $L_s$ is increased. Thus, one solves the above equation for $D_{eq}$. With the channel height being constant (e.g., the barrier layer height), the angle $\alpha_c=\alpha_d$ is directly related to the calculated equivalent hydraulic diameter.

Following are values for $L_s$ and $\alpha_c=\alpha_d$ for an exemplary multiplex pattern of 22 different lengths $L_s$ as shown in FIG. 5. The pinch point constriction width is constant at 27.5 microns and the nozzle chamber width is constant at 51 microns for the example pattern.

| $L_s$ ($\mu$m) | $\alpha_c = \alpha_d$ ($\mu$m) |
|---|---|
| 111.25 | 19.56 |
| 113 | 20.23 |
| 114.5 | 20.81 |
| 116.25 | 21.48 |
| 118 | 22.15 |
| 119.75 | 22.82 |
| 121.5 | 23.49 |
| 123.25 | 24.16 |
| 125 | 24.83 |
| 126.75 | 25.5 |
| 128.5 | 26.17 |
| 130.25 | 26.84 |
| 132 | 27.51 |
| 133.75 | 28.18 |
| 135.5 | 28.85 |
| 137.25 | 29.52 |
| 138.75 | 30.09 |
| 140.5 | 30.76 |
| 142.25 | 31.43 |
| 144 | 32.10 |
| 145.75 | 32.77 |
| 147.5 | 33.44 |

Thus, the angles $\alpha_c=\alpha_d$ are derived as a function of $L_s$. Following is an equation determining the length from the nozzle chamber entry to the constriction 62 for any given printing element 42.

$$\tan\alpha_d=(W_c-W_p)/2L_{pp}$$

where $L_{pp}$ is the length from the nozzle chamber entrance to the constriction 62;
$W_c$ is the nozzle chamber width;
$W_p$ is the pinch point constriction width; and
$\alpha_d$ is the diverging half angle.

In an alternative embodiment employing a partially circular firing chamber 56 such as that shown in FIG. 7, the values for $L_s$ and $\alpha_c=\alpha_d$ are listed below for 20 different lengths of $L_s$, where the pinch point constriction width is 27.5 $\mu$m and the diameter of the circular firing chamber is 52 $\mu$m:.

| $L_s$ ($\mu$m) | $\alpha_c = \alpha_d$ ($\mu$m) |
|---|---|
| 107 | 17.86 |
| 109 | 18.63 |
| 110.75 | 19.22 |
| 112.75 | 19.83 |
| 114.5 | 20.31 |
| 116.5 | 20.82 |
| 118.25 | 21.22 |
| 120.25 | 21.64 |
| 122.25 | 22.02 |
| 124 | 22.33 |
| 126 | 22.66 |

-continued

| $L_s$ ($\mu$m) | $\alpha_c = \alpha_d$ ($\mu$m) |
|---|---|
| 127.75 | 22.92 |
| 129.75 | 23.20 |
| 131.75 | 23.47 |
| 133.5 | 23.68 |
| 135.5 | 23.91 |
| 137.25 | 24.10 |
| 139.25 | 24.31 |
| 141 | 24.47 |
| 143 | 24.66 |

Again, the angles $\alpha_c=\alpha_d$ are derived as a function of $L_s$. The distance y from the center of the firing resistor 58 (and the center of the circular firing chamber 56) to the pinch point constriction 62 is determined by the equation $$Y = \frac{W_C - W_P\cos\alpha}{2\sin\alpha}$$

Figure 7:
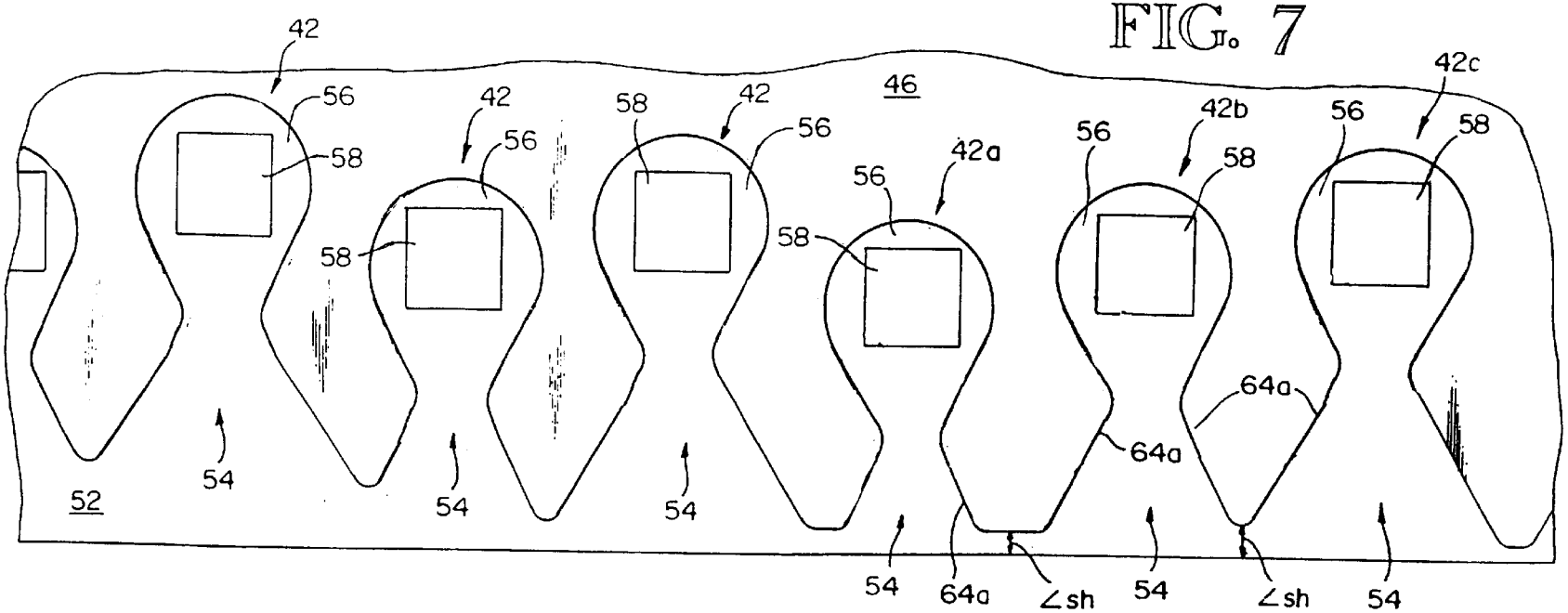
FIG. 7 is a plan view of an alternative design of an inkjet printhead (in which the printhead nozzle plate is not shown).

Where:

$W_c$ is the diameter of the circular firing chamber 56 of FIG. 7

Figure 8:
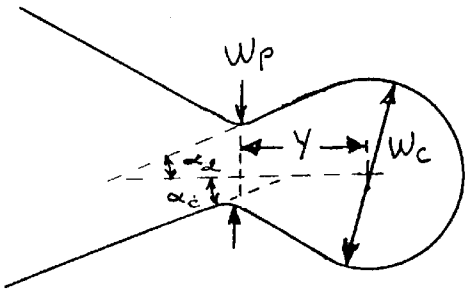
FIG. 8 is an illustration of the shape of the barrier wall outline in the area of a nozzle chamber which can be employed in the alternative design of FIG. 7.

$W_p$ is the pinch point constriction width; and $\alpha_d$ is the diverging half angle as shown in FIG. 8.

Pen Cartridge

Figure 6:
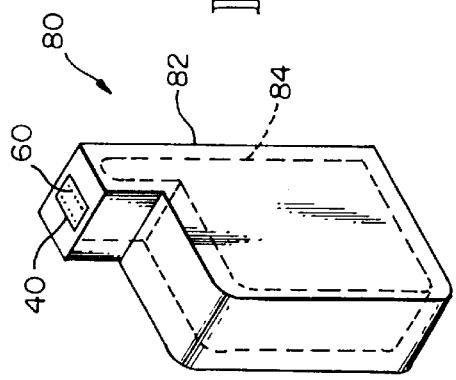
FIG. 6 is a perspective view of an inkjet pen cartridge having the printhead of FIGS. 3–5 according to an embodiment of this invention.

FIG. 6 shows an inkjet pen cartridge 80 according to an embodiment of this invention. The cartridge 80 includes a case 82, an internal reservoir 84 and the printhead 40. The printhead 40 includes multiple rows of nozzles 60, and is formed as described above. In alternative embodiments the ink reservoir is separate from and external to the pen cartridge.

Meritorious and Advantageous Effects

According to an advantage of this invention, the variable pinch point angle among a set of printing elements substantially reduces volume and velocity variation from printing element to printing element at all firing frequencies.

According to another advantage of the invention, the variable pinch point angle among a set of printing elements substantially reduces volume and velocity variation from printing element to printing element under steady state conditions. According to another advantage of the invention, ink refill is balanced from printing element to printing element even with high density printing element spacing and short shelf lengths.

Although a preferred embodiment of the invention has been illustrated and described, various alternatives, modifications and equivalents may be used. Therefore, the foregoing description should not be taken as limiting the scope of the inventions which are defined by the appended claims.

What is claimed is:

1. An inkjet printhead for ejecting ink droplets onto a print medium, said printhead comprising:

a plurality of resistive elements for heating ink supplied from a reservoir to generate said ink droplets;

a plurality of nozzles through which said ink droplets are ejected, with one nozzle associated with one resistive element;

a plurality of firing chambers with one nozzle and one resistive element associated with one firing chamber, each one firing chamber enclosed on a side by a barrier, each one firing chamber having a base supporting said one associated resistive element, with said one associated nozzle above said one associated resistive element;

a plurality of ink feed channels with one feed channel associated with one firing chamber, each one feed channel for supplying ink to said one associated firing chamber through a firing chamber entrance through said essentially enclosing barrier of said associated firing chamber, wherein for each said one feed channel a pair of opposed projections separated by a first width are formed in walls to said one feed channel to cause a constriction, wherein said walls converge along feed channel length toward the constriction at a first angle and diverge along feed channel length from the constriction toward the firing chamber at a second angle, wherein the first angle is equal to the second angle; and an ink refill channel operatively associated with said plurality of ink feed channels, the ink refill channel defined by an edge;

wherein said plurality of resistive elements are grouped into sets, with resistive elements within a given set staggered at different distances from said edge, and wherein the first angle is prescribed as a function of the distance for the resistive element associated with a given feed channel.

2. The printhead of claim 1 in which each one of the plurality of feed channels comprises no more than one constriction, and in which the barrier walls of a given feed channel diverge along feed channel length from the constriction toward the firing chamber at said second angle to define the firing chamber entrance.

3. The printhead of claim 1, in which the first width is the same for each one of the plurality of ink feed channels.

4. The printhead of claim 1, wherein a volumetric flow rate of ink through each one ink feed channel of respective printing elements in a given set of printing elements is generally balanced for said given set of printing elements by having the first width for each one ink feed channel of said given set be prescribed as a function of said distance for the resistive element associated with said each one feed channel of said given set.

5. An inkjet printhead for ejecting ink droplets onto a print medium, said printhead comprising:

a plurality of printing elements formed in one or more layers of said printhead; and an ink refill channel defined by an edge of said one or more layers; and wherein each one of a multiple of said plurality of printing elements comprises:

(a) a resistive element for heating ink supplied from a reservoir to generate said ink droplets;

(b) a nozzle through which said ink droplets are ejected;

(c) a firing chamber essentially enclosed by a first layer and having a base supporting said resistive element, the nozzle aligned with the firing chamber; and (d) an ink feed channel for supplying ink to said firing chamber through a firing chamber entrance through said essentially enclosing barrier of said firing chamber, wherein said feed channel has a pair of opposed projections separated by a first width formed in walls to said one feed channel to cause a constriction, wherein said walls converge along feed channel length from a feed channel entrance toward the constriction at a first angle and diverge along feed channel length from the constriction toward a feed channel exit at the firing chamber at a second angle, wherein the first angle is equal to the second angle; and wherein the ink refill channel is operatively associated with said ink feed channel; and wherein said plurality of printing elements are grouped into sets, with component resistive elements of a given set staggered at different distances from said edge, and wherein the first angle is prescribed as a function of the distance for the resistive element associated with a given feed channel.

6. The printhead of claim 5, in which each one of the plurality of feed channels comprises no more than one constriction, and in which the barrier walls of a given feed channel diverge along feed channel length from the constriction toward the firing chamber at said second angle to define the firing chamber entrance.

7. The printhead of claim 5, in which the first width is the same for the ink feed channel of each one of the plurality of printing elements.

8. The printhead of claim 5, wherein a volumetric flow rate of ink through each one ink feed channel of respective printing elements in a given set of printing elements is generally balanced for said given set of printing elements by having the first width for each one ink feed channel of said given set be prescribed as a function of said distance for the resistive element associated with said each one feed channel of said given set.

9. An inkjet pen for ejecting ink droplets onto a print medium, said pen comprising:

a casing; and a printhead mounted to the casing, the printhead having a plurality of printing elements formed in one or more layers of said printhead, and an ink refill channel defined by an edge of said one or more layers; and wherein each one of a multiple of said plurality of printing elements comprises:

(a) a resistive element for heating ink supplied from a reservoir to generate said ink droplets;

(b) a nozzle through which said ink droplets are ejected;

(c) a firing chamber essentially enclosed by a first layer and having a base supporting said resistive element, the nozzle aligned with the firing chamber; and (d) an ink feed channel for supplying ink to said firing chamber through a firing chamber entrance through said essentially enclosing barrier of said firing chamber, wherein said feed channel has a pair of opposed projections separated by a first width formed in walls to said one feed channel to cause a constriction, wherein said walls converge along feed channel length from a feed channel entrance toward the constriction at a first angle and diverge along feed channel length from the constriction toward a feed channel exit at the firing chamber at a second angle, wherein the first angle is equal to the second angle; and wherein the ink refill channel is operatively associated with said ink feed channel; and wherein said plurality of printing elements are grouped into sets, with component resistive elements of a given set staggered at different distances from said edge, and wherein the first angle is prescribed as a function of the distance for the resistive element associated with a given feed channel.

10. The printhead of claim 9, in which each one of the plurality of feed channels comprises no more than one constriction, and in which the barrier walls of a given feed channel diverge along feed channel length from the constriction toward the firing chamber at said second angle to define the firing chamber entrance.

11. The printhead of claim 9, in which the first width is the same for the ink feed channel of each one of the plurality of printing elements.

12. The printhead of claim 9, wherein a volumetric flow rate of ink through each one ink feed channel of respective printing elements in a given set of printing elements is generally balanced for said given set of printing elements by having the first width for each one ink feed channel of said given set be prescribed as a function of said distance for the resistive element associated with said each one feed channel of said given set.

* * * * *